US008966905B2

(12) United States Patent
De La Cruz Garcia et al.

(10) Patent No.: US 8,966,905 B2
(45) Date of Patent: Mar. 3, 2015

(54) COMBUSTION DEVICE

(75) Inventors: Marta De La Cruz Garcia, Zürich (CH); Nicolas Noiray, Bern (CH); Ghislain Singla, Baden (CH)

(73) Assignee: Alstom Technology Ltd., Baden (CH)

( * ) Notice: Subject to any disclaimer, the term of this patent is extended or adjusted under 35 U.S.C. 154(b) by 628 days.

(21) Appl. No.: 13/217,979

(22) Filed: Aug. 25, 2011

(65) Prior Publication Data

US 2012/0047896 A1 Mar. 1, 2012

(30) Foreign Application Priority Data

Aug. 25, 2010 (EP) ..... 10174015

(51) Int. Cl.

| | |
|---|---|
| ***F02C 7/228*** | (2006.01) |
| ***F23R 3/12*** | (2006.01) |
| ***F23R 3/30*** | (2006.01) |
| ***F23R 3/28*** | (2006.01) |
| ***F23D 14/02*** | (2006.01) |

(52) U.S. Cl.

CPC ..... *F23R 3/286* (2013.01); *F23D 14/02* (2013.01)

USPC ..... 60/737; 60/748

(58) Field of Classification Search

USPC ..... 60/725, 746, 39.37, 737, 748; 431/114

See application file for complete search history.

(56) References Cited

U.S. PATENT DOCUMENTS

| | | | | |
|---|---|---|---|---|
| 4,271,675 | A * | 6/1981 | Jones et al. | 60/737 |
| 5,081,844 | A * | 1/1992 | Keller et al. | 60/737 |
| 5,983,643 | A | 11/1999 | Kiesow | |
| 6,430,930 | B1 | 8/2002 | Andersson | |
| 6,449,951 | B1 | 9/2002 | Joos et al. | |
| 6,918,256 | B2 | 7/2005 | Gutmark et al. | |
| 7,013,635 | B2 * | 3/2006 | Cohen et al. | 60/204 |
| 7,578,130 | B1 * | 8/2009 | Kraemer et al. | 60/737 |
| 2002/0177093 | A1 | 11/2002 | Paschereit et al. | |
| 2003/0041588 | A1 | 3/2003 | Joos et al. | |

FOREIGN PATENT DOCUMENTS

| | | |
|---|---|---|
| DE | 43 36 096 A1 | 5/1994 |
| DE | 198 09 364 A1 | 9/1998 |
| DE | 199 39 235 A1 | 2/2001 |

(Continued)

OTHER PUBLICATIONS

Search Report issued on Apr. 13, 2011, by European Patent Office for Application No. 10174015.7.

(Continued)

*Primary Examiner* — Andrew Nguyen

(74) *Attorney, Agent, or Firm* — Buchanan Ingersoll & Rooney PC

(57) ABSTRACT

A combustion device includes a plurality of mixing devices into which a fluid containing oxygen and a fuel are introduced and mixed to form a mixture. The combustion device also includes a combustion chamber in which the mixture formed in the mixing devices is burnt. Each mixing device has a conical body with a lance projecting into the conical body, where the fuel is injectable into the conical body. Tips of the lances of different mixing devices have different distances from corresponding open ends of the respective conical bodies.

5 Claims, 3 Drawing Sheets

(56) References Cited

FOREIGN PATENT DOCUMENTS

| | | | |
|---|---|---|---|
| DE | 100 55 408 | A1 | 5/2002 |
| DE | 102 05 839 | A1 | 8/2003 |
| DE | 196 15 910 | B4 | 9/2006 |
| WO | WO 00/09945 | A1 | 2/2000 |
| WO | WO 2007/113130 | A1 | 10/2007 |

OTHER PUBLICATIONS

Search Report dated Mar. 30, 2012, issued by the German Patent Office in the corresponding German Patent Application No. 102011110143.1. (5 pages).

* cited by examiner

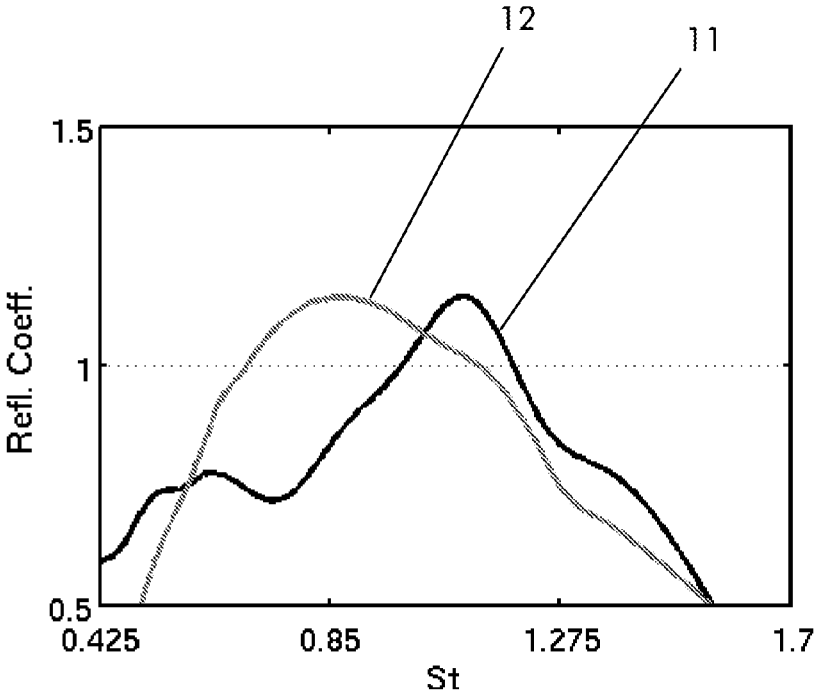
Fig. 5
Fig. 6
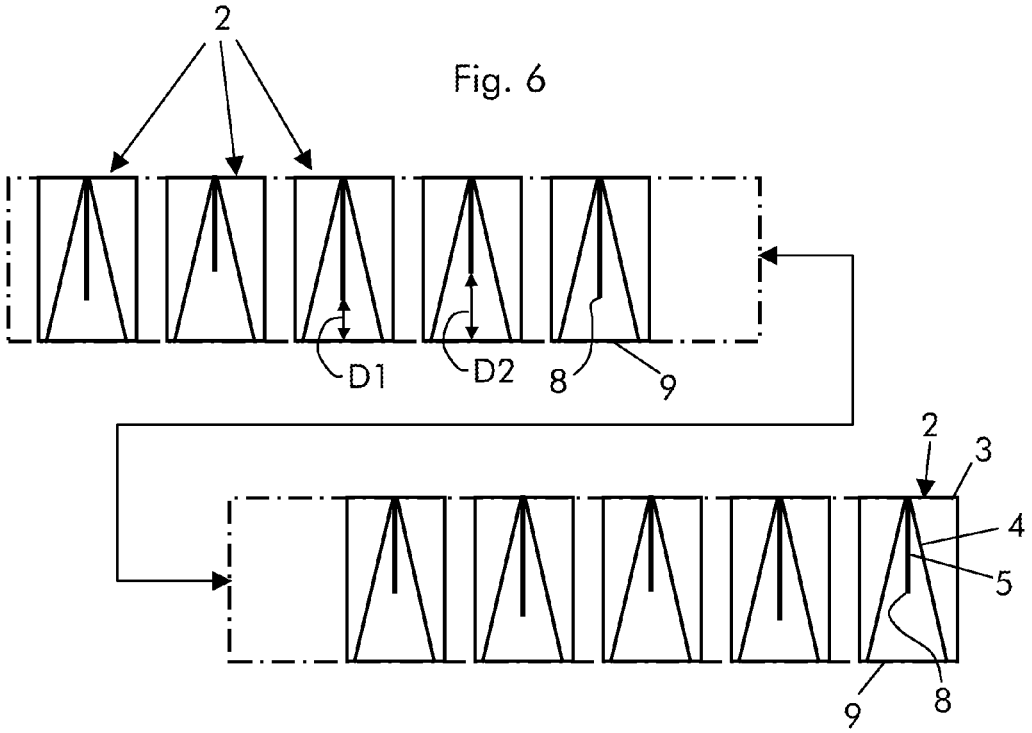

COMBUSTION DEVICE

RELATED APPLICATION

This application claims priority under 35 U.S.C. §119 to European Patent Application No. 10174015.7 filed in Europe on Aug. 25, 2010, the entire content of which is hereby incorporated by reference in its entirety.

FIELD

The present disclosure relates to a combustion device, such as a combustion device of a gas turbine, for example.

BACKGROUND INFORMATION

Combustion devices of gas turbines are known to comprise a plurality of mixing devices, wherein a fluid (e.g., air) containing oxygen is supplied and is mixed with a fuel injected via lances projecting thereinto, to form a mixture.

The mixture passes through the mixing devices and enters a combustion chamber connected downstream of the mixing devices. Combustion of the mixture occurs in the combustion chamber.

The mixing devices are generally identical to each other. For instance, the mixing devices each have a conical body with lateral slots for the air entrance and a lance located axially in the conical body for the fuel injection. In addition, nozzles are often also located at the conical body.

During operation, the fuel is injected via the lance and/or nozzles into the conical body, and it is mixed with the air entering via the slots to form the mixture that then enters the combustion chamber and burns.

During combustion, pressure pulsations are generated. These pressure pulsations may be detrimental for the longevity of the combustion device and must be damped.

For this reason, the mixing devices connected to one combustion chamber are usually grouped in groups of four or more mixing devices. In each group, one of the mixing devices is operated at a temperature that is lower than the operating temperature of the other mixing devices of the same group (in practice, the amount of fuel supplied is lower than the amount of fuel supplied to the other mixing devices).

This operating mode causes the pressure oscillations that the mixing devices naturally generate during operation to be compensated for and balanced, such that no or low pressure pulsations emerge from the combustion device.

Nevertheless, since the temperature in the combustion chamber is not uniform (e.g., there are colder areas fed by leaner mixing devices and hotter areas fed by richer mixing devices), the temperature, for example, at the first stages of the turbine is also not uniform. This causes stress to both the combustion device (e.g., its combustion chamber) and the rotor blades in front of it, where such stress may lead to a reduced lifetime of the affected components.

In addition, in some operating conditions, the control of the fuel in the different mixing devices of the same group can be difficult. For example, fuel adjustment of the mixing devices that must receive a reduced amount of fuel is difficult at different operating loads.

SUMMARY

An exemplary embodiment of the present disclosure provides a combustion device which includes a plurality of mixing devices into which a fluid containing oxygen and a fuel are introduced to be mixed to form a mixture, and a combustion chamber configured to burn the mixture formed in the mixing devices. Each mixing device includes a conical body having an open end toward the combustion chamber, and a lance projecting thereinto, each conical body being configured to accommodate injection of the fuel thereinto toward its open end. Each of the lances has a corresponding tip. The lance tips of different mixing devices have different distances from the open end of the corresponding conical body, respectively.

BRIEF DESCRIPTION OF THE DRAWINGS

Additional refinements, advantages and features of the present disclosure are described in more detail below with reference to exemplary embodiments illustrated in the drawings, in which:

FIGS. 3-5 show the reflection coefficient of mixing devices operating at different temperatures and having the lance in different positions, in accordance with an exemplary embodiment of the present disclosure; and FIG. 6 shows a schematic cross section through the dashed and dot circumference of FIG. 1 in accordance with an exemplary embodiment of the present disclosure (for space reason this cross section is depicted in two pieces linked by an arrow).

DETAILED DESCRIPTION

Exemplary embodiments of the present disclosure provide a combustion device in which pulsation damping is achieved without the need to operate different mixing devices connected to the same combustion chamber at different temperatures.

The exemplary embodiments of the present disclosure therefore enable an increased lifetime for both the combustion device and the rotor blades facing it.

Exemplary embodiments of the present disclosure also provide a combustion device which makes fuel injection control easy in all operating conditions.

Figure 1:
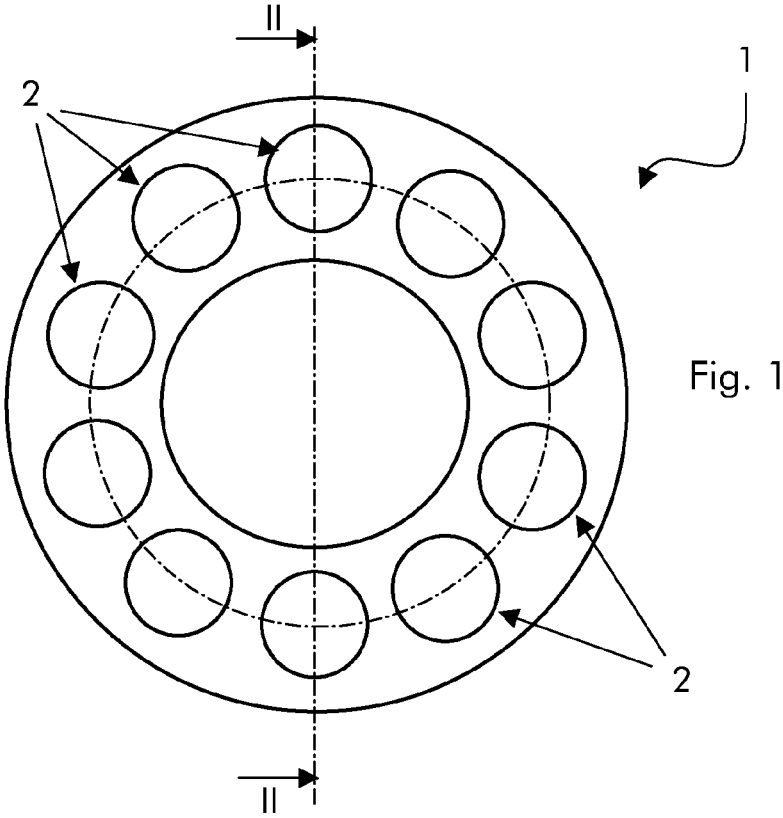
FIG. 1 is a schematic front view of a portion of a combustion device in accordance with an exemplary embodiment of the present disclosure.
Figure 2:
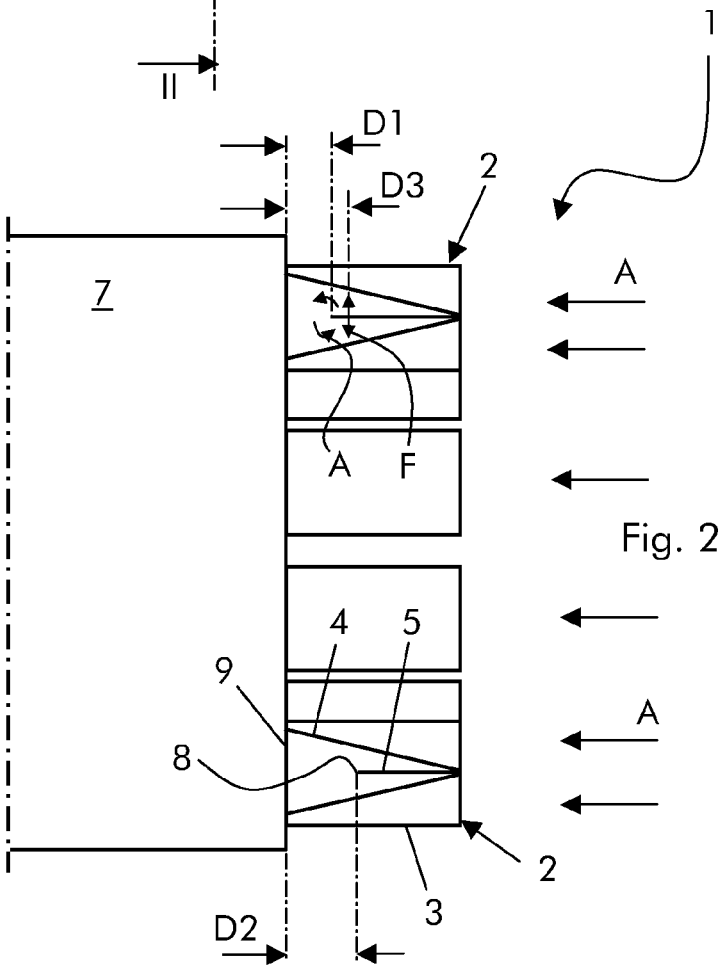
FIG. 2 is a schematic cross section of the combustion device through line II-II of FIG. 1.

FIGS. 1 and 2 illustrate a combustion device 1 of a gas turbine according to an exemplary embodiment of the present disclosure. FIG. 1 is a schematic front view of a portion of a combustion device 1 in accordance with an exemplary embodiment of the present disclosure, and FIG. 2 is a schematic cross section of the combustion device through line II-II of FIG. 1.

The combustion device 1 has a plurality of mixing devices 2, wherein a fluid A (e.g., air) containing oxygen and a fuel F (e.g., oil, methane or natural gas) are introduced and mixed to form a mixture.

The mixing devices 2 can include an enclosure 3 containing a substantially conical body 4. The conical body 4 includes tangential slots through which the fluid A may enter thereinto and nozzles close to the slots for injection of the fuel F.

A lance 5, which includes a lance tip 8, can be housed within the conical body 4. The fuel F can be injected through the lance 5. In accordance with an exemplary embodiment, the lance 5 is connected to a fuel supply circuit that feeds the lance 5 and thus the mixing device 2 with fuel F.

The mixing devices 2 are connected to a combustion chamber 7 that can have, for example, an annular structure. In the drawings, only ten mixing devices 2 are shown connected to the combustion chamber 7. However, it is clear that the number of mixing devices 2 may be smaller or larger than the ten illustrated, and that the mixing devices 2 may also be arranged in two or more circumferential lines instead of only one.

In accordance with an exemplary embodiment as shown in the drawings, the lance tips 8 of different mixing devices 2 can have different distances D1, D2 from the open ends 9 of the corresponding conical body 4, respectively.

For example, in the exemplary embodiment illustrated in FIG. 2, the conical bodies 4 of the mixing devices 2 are identical except that the lances 5 are positioned differently with respect to the distances D1, D2 from the open ends 9 of the conical bodies 4. In the exemplary embodiment illustrated in FIG. 2, the distance D1 between the lance tip 8 and the open end 9 of the uppermost conical body 4 is less than the distance D2 between the lance tip 8 and the open end 9 of the lowermost conical body 4.

In accordance with an exemplary embodiment, the lance tips 8 closer to the open end 9 of the conical body 4 are alternated with the lance tips 8 farther from the open end 9 of the conical body 4.

For example, each burner with a lance tip 8 closer to the open end 9 of the conical body 4 can be followed by a burner with a lance tip 8 farther from the open end 9 of the conical body 4, and each burner with a lance tip 8 farther from the open end 9 of the conical body 4 is followed by a burner with a lance tip 8 closer to the open end 9 of the conical body 4.

In accordance with an exemplary embodiment, all the mixing devices 2 having a lance tip 8 closer to the open end 9 of the conical body 4 can have the same distance between the lance tip 8 and the open end 9 of the conical body 4, and all the mixing devices 2 having a lance tip 8 farther from the open end 9 of the conical body 4 can have the same distance between the lance tip 8 and the open end 9 of the conical body 4.

Of course, even though only two different distances D1, D2 are shown, it is also possible to provide more than two distances between the lance tips 8 and the open ends 9 of the conical body 4. These distances may be alternated or not according to design specifications.

In accordance with an exemplary embodiment, the lances 5 have nozzles at their lateral side. The nozzles of all lances 5 may have the same distance D3 from the open ends 9 of the conical body 4 or a different distance from the open ends 9 of the conical body 4.

The particular lance disposition may be achieved in a different way.

According to an exemplary embodiment, lances 5 having the appropriate structure and length may be provided. For example, the lances 5 may have a length such that when they are connected into the conical body 4 their tips 8 have the correct, design distance D1, D2 from the conical body open end 9. This embodiment is beneficial, for example, in case the nozzles of all lances 5 must have the same distance D3 from the open ends 9 of the conical body 4.

Alternatively, the lances 5 may be regulated such that their tips 8 may be arranged at a distance from the open end 9 comprised in a prefixed range.

For example, the lances 5 may have a telescopic portion for the regulation of their length. In this case, the telescopic portion may be housed within the conical body 4 or also outside of it. This embodiment is beneficial, for example, in case the nozzles of the lances 5 have different distances D3 from the open ends 9 of the conical body 4.

In addition, further nozzles at the conical body 4 (for example, in positions close to the slots) to feed fuel may be provided.

The operation of the combustion device according to exemplary embodiments of the present disclosure is apparent from the foregoing description and illustration. For clarity of illustration, the operation of the combustion device is described in further detail below.

The fluid A (e.g., air) containing oxygen enters the enclosures 3 and then, passing through the slots, it enters the conical body 4. Correspondingly, the fuel F is injected via the lances 5. Within the conical body 4, the fluid A has a large turbulence and vortices that allows for an intimate mixing between the fluid A and fuel F.

In addition, the fuel F can also be injected in the conical body 4 from the nozzles at the slots.

The mixture of fluid A and fuel F then moves downstream, entering the combustion chamber 7 where the mixture burns.

During combustion, each mixing device 2 generates pressure oscillations that propagate in the combustion chamber 7 and interfere with the pressure oscillations generated by the other mixing devices 2.

Since the pressure oscillations generated by each mixing device 2 depend on the geometrical features and operating conditions of the relevant mixing device, the pressure oscillations generated by mixing devices 2 having the lances 5 arranged differently will in general be different and may also be very different from each other.

In order to estimate the pulsation behavior of a mixing device 2, the reflection coefficient can be used.

The reflection coefficient is measured by providing the mixing device 2 at one end of a channel and providing an acoustic driver and several pressure sensors at the other end of the channel.

The acoustic driver generates pressure waves that propagate through the channel, reach the mixing device and are reflected back.

The sensors detect the forward and backward components of the acoustic waves in the channel.

The reflection coefficient is defined as the ratio between the amplitude of the incident acoustic waves (generated by the acoustic driver) and the reflected ones (e.g., those reflected by the mixing device).

In case the reflection coefficient is greater than 1, pressure oscillations that are naturally generated during operation are amplified and may lead to significantly high pressure pulsations in the combustion chamber (e.g., it depends on the combustion chamber acoustic features) that may in turn lead to a troubling operation.

The reflection coefficient also depends on the operating temperature, because this temperature influences the acoustic behavior of the mixing devices.

Figure 3:
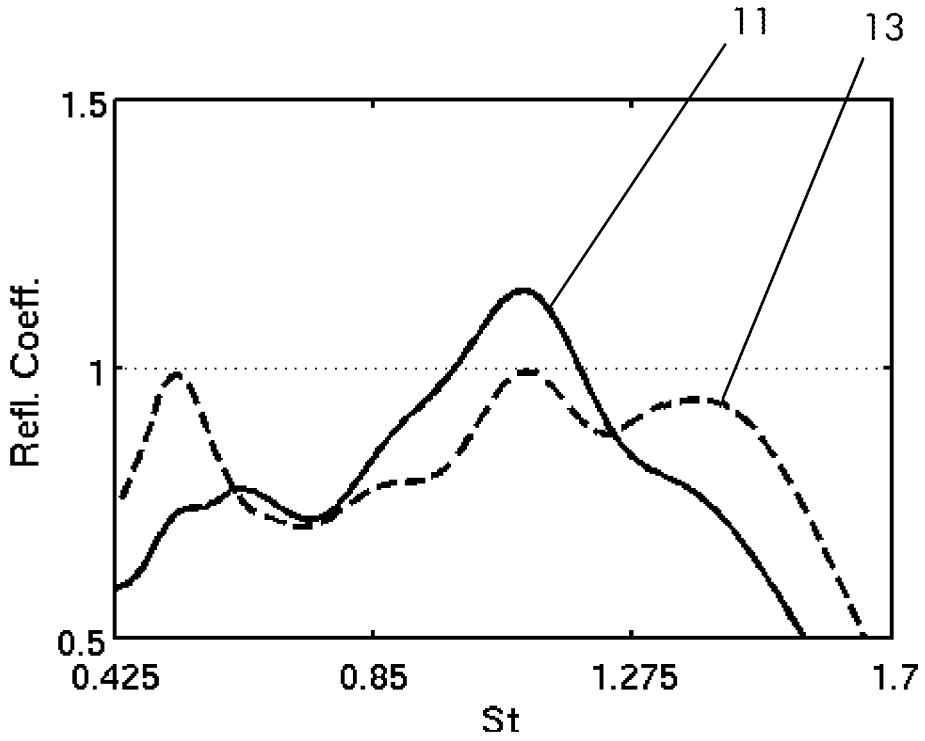
Figure 4:
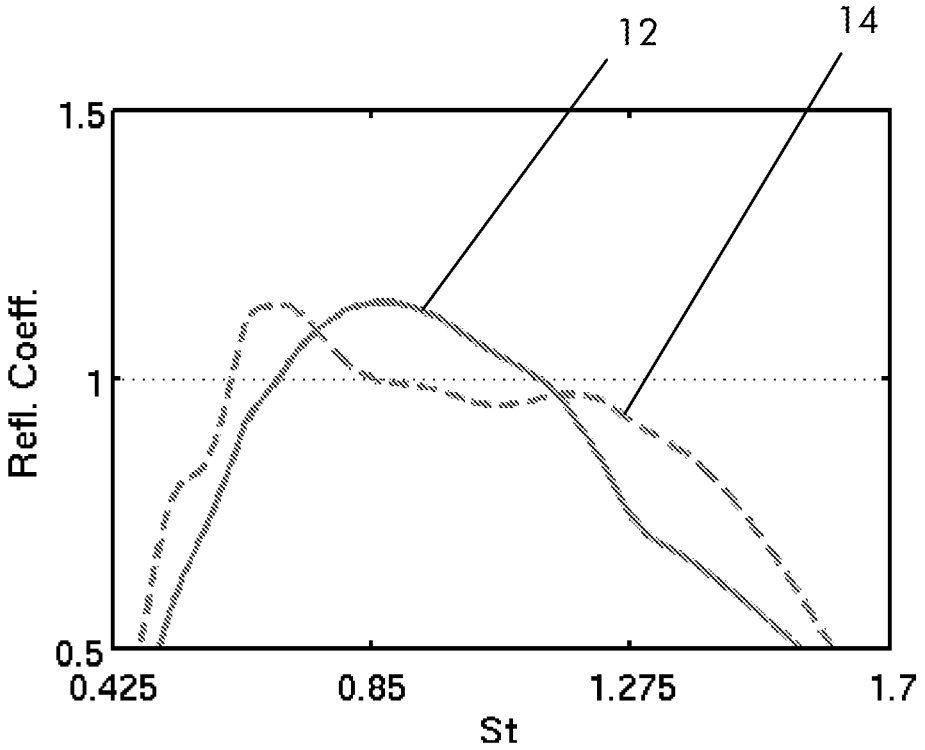

In the following, reference to FIGS. 3-5 is made. These drawings are plotted with reference to identical mixing devices having identical operating parameters (for example, air and fuel mass flow, inlet temperature, cooling, etc); only the lance position is different as explained in the following.

For instance, FIGS. 3-5 show the relationship between the reflection coefficient (Refl. Coeff.) and the Strouhal number (St).

The Strouhal number (St) is the normalized frequency of the pressure oscillations; it is the ratio between the frequency (f) multiplied by the diameter of the largest base of the conical body (e.g., at its end 9, D) and the velocity (U) of the fluid A in the mixing device:

$$St = f \cdot D / U.$$

The examples given in these drawings are not restrictive and are mainly used to illustrate the effectiveness of the lance arrangement on pulsation's behavior of the mixing devices.

FIG. 5 shows the reflection coefficient of two mixing devices having identical structure (e.g., conical body, lance structure and position, etc.) but operated with combusted gases at a temperature $T_1$ (curve 11) and $T_2$=1.07 $T_1$ (curve 12), respectively.

As illustrated in FIG. 5, the influence of the temperature on the reflection coefficient is clearly shown; this influence is sometimes used in combustion devices 1 in order to avoid pulsations by taking advantage of the destructive acoustic interferences obtained with groups of mixing devices operated at different hot gas temperature.

In contrast, FIGS. 3 and 4 show the reflection coefficient of a mixing device having the same features as those used to plot FIG. 5 and another mixing devices with the lance 5 differently positioned therein.

In particular, FIG. 3 shows the reflection coefficient plotted for a temperature $T_1$ (curve 11 refers to a mixing device identical to the one used to plot FIG. 5, and curve 13 refers to a mixing device having the same features, but with the lance 2 cm farther from the conical body open end).

Likewise, FIG. 4 shows the reflection coefficient plotted for the temperature $T_2$ (curve 12 refers to a mixing device identical to the one used to plot FIG. 5, and curve 14 refers to a mixing device having the same features, but with the lance 2 cm farther from the conical body open end).

From FIGS. 3 and 4, it can be ascertained that the influence of the lance position on the reflection coefficient is very large (for each temperature) and can be used to balance the different acoustic behavior of the mixing devices, without the need of, or in addition to, operating them at different temperatures.

Since the mixing devices can be operated all at the same temperature or with reduced differential temperatures, efficiency and lifetime are increased when compared to known combustion devices. In addition, no complex control system of the fuel supplied into the mixing devices must be provided, since all the mixing devices can be fed with the same fuel mass flow.

Naturally, the features of the exemplary embodiments described above may be independently provided from one another.

In practice, the materials used and the dimensions can be chosen at will according to requirements.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1 combustion device
2 mixing device
3 enclosure
4 conical body
5 lance
7 combustion chamber
8 lance tip
9 open end of conical body
11 reflection coefficient of a mixing device operating at $T_1$ with lance in the standard position
12 reflection coefficient of a mixing device operating at $T_2$ with lance in the standard position
13 reflection coefficient of a mixing device operating at $T_1$ with lance switched inwards by 2 cm
14 reflection coefficient of a mixing device operating at $T_2$ with lance switched inwards by 2 cm
D1, D2 distance of 8 from 9
D3 distance of the nozzle of the lance from 9
A fluid
F fuel

What is claimed is:

1. A combustion device comprising:

a plurality of mixing devices into which a fluid containing oxygen and a fuel are introduced to be mixed to form a mixture; and a combustion chamber configured to burn the mixture formed in the mixing devices, wherein:

each mixing device includes a conical body having an open end toward the combustion chamber, and a lance projecting thereinto, the conical bodies of the mixing devices including tangential slots for entry of the fluid and first nozzles close to the slots for injection of the fuel, each conical body being configured to accommodate injection of the fuel thereinto at the first nozzles of the conical body, the conical bodies of the mixing devices being identical to each other;

each of the lances has a corresponding tip and a second nozzle at a lateral side of the corresponding lance; and the lance tips of different mixing devices have different distances from the open end of the corresponding conical body;

wherein each mixing device with a lance tip closer to the open end of the corresponding conical body is followed by a mixing device with a lance tip farther from the open end of the corresponding conical body; and each mixing device with a lance tip farther from the open end of the corresponding conical body is followed by a mixing device with a lance tip closer to the open end of the corresponding conical body.

2. The combustion device as claimed in claim 1, wherein lance tips closer to the open end of the corresponding conical bodies are alternated with lance tips farther from the open end of the corresponding conical bodies.

3. The combustion device as claimed in claim 1, wherein the lances have a telescopic portion for the regulation of their length.

4. The combustion device as claimed in claim 1, wherein:

all the mixing devices having a lance tip closer to the open end of the corresponding conical body have the same distance between the lance tip and the open end of the corresponding conical body; and all the mixing devices having a lance tip farther from the open end of the corresponding conical body have the same distance between the lance tip and the open end of the corresponding conical body.

5. The combustion device as claimed in claim 2, wherein the lances have a telescopic portion for the regulation of their length.

* * * * *